United States Patent [19]

Lu

[11] Patent Number: 4,722,120

[45] Date of Patent: Feb. 2, 1988

[54] SPRING CLIP

[76] Inventor: James Lu, 3, 6th Fl., No. 512, Sec. 4, Chung-Hsiao E. Rd., Taipei, Taiwan

[21] Appl. No.: 65,373

[22] Filed: Jun. 23, 1987

[51] Int. Cl.[4] ..... A44B 21/00

[52] U.S. Cl. ..... 24/489; 24/499; 24/564

[58] Field of Search ..... 24/489, 499, 490, 536, 24/562, 564

[56] References Cited

U.S. PATENT DOCUMENTS

| | | | |
|---|---|---|---|
| 277,700 | 5/1883 | Foster | 24/489 |
| 613,816 | 11/1898 | Harrison | 24/490 |
| 903,373 | 11/1908 | Hall | 24/499 |
| 2,118,475 | 5/1938 | Pallas | 24/490 |
| 3,041,696 | 7/1962 | Ferri, Jr. | 24/564 |
| 3,135,034 | 6/1964 | Fauteux | 24/489 |
| 3,349,453 | 10/1967 | Iida et al. | 24/489 |
| 4,506,416 | 3/1985 | Ohminato et al. | 24/489 |

*Primary Examiner*—Victor N. Sakran

*Attorney, Agent, or Firm*—Roylance, Abrams, Berdo & Goodman

[57] ABSTRACT

A spring clip includes bosses and pivot holes on flanges at two opposite sides of each of two clamping members for connecting pivotally the clamping members wherein the flange bearing the boss at each side is sandwiched between two other flanges bearing the pivot holes, thereby preventing the bosses from being released easily from the pivot holes. A torsion spring is mounted conveniently on the clamping members by engaging it with retaining members disposed on the clamping members.

3 Claims, 4 Drawing Figures

SPRING CLIP

BACKGROUND OF THE INVENTION

This invention relates to a spring clip, and particularly to a spring clip having bosses and pivot holes on flanges at two opposite sides of two clamping members for connecting pivotally the clamping members wherein the flange bearing the boss at each side is sandwiched between two other flanges bearing the pivot holes, and a torsion spring is mounted on the clamping members by engaging it with retaining members disposed on the clamping members.

Spring clips exist in various forms in the art. One of the spring clips is shown in FIG. 1 in which two clamping members are provided with opposing protruded surfaces through which the clamping members are fulcrumed and engage with one another. A spring B in the form of a bent rod is attached to the clamping members with its arms engaging in slots of the clamping members so as to urge the clamping members to a clamping position. Such a clip is convenient to assemble, but the effectiveness of the clip is lost easily since the clamping members are displaced easily from their proper position relative to the spring. FIG. 2 shows another spring clip in which two clamping members are pivoted to one another by using a pin which passes through the holes of flanges of the clamping members. A torsion spring is sleeved around the pin. Although the construction of this spring is durable, the assembly thereof is rather inconvenient.

SUMMARY OF THE INVENTION

An object of the invention is to provide an improved spring clip which is not only durable but also easy to assemble.

The invention provides a spring clip which comprises a first clamping member having a first clamping portion and a first press plate portion, a second clamping member having a second clamping portion, a second press plate portion. The first and second press plate portions are connected pivotally to one another to turn about a pivot axis so as to cause the first and second clamping portions to move towards or away from one another. Each of the first and second plate portions includes at one side thereof a first flange extending inwardly and perpendicular to the pivot axis and having a boss of circular cross-section extending perpendicularly from the first flange, and at the opposite side thereof a second flange parallel to the first flange, having a pivot hole. The boss of the first or second press plate portion is inserted into the pivot hole of the second or first press plate portion.

Each of the first and second press plate portions further has a third flange parallel to and spaced apart from the second flange to create a gap between the second and third flanges so as to sandwich the first flange when the boss is inserted into the pivot hole. Each boss has an end face slanted relative to a plane perpendicular to the pivot axis to enable the first flange to wedge in between respective second and third flanges.

A torsion spring is disposed between the first and second press plate portions, and include a coiled portion, a first arm at one side of the coiled portion extending toward the first press plate portion and having an inwardly bent end parallel to the pivot axis, and a second arm at another side of the coiled portion extending toward the second press plate portion and having an inwardly bent end parallel to the pivot axis.

There is a spring retaining means including at the inner surface of the second press plate portion a transverse ridge which is parallel to the pivot axis and engages with the bent end of the second arm, and a longitudinal projection at the inner surface of the second press between the first and third flanges. The longitudinal projection has a curved engaging surface with a gradually increasing height from one end near the transverse ridge to the opposite other end to serve as a seat for the coiled portion of the spring.

The present exemplary preferred embodiment will be described in detail with reference to the accompanying drawings, in which:

DETAILED DESCRIPTION OF THE PREFERRED EMBODIMENT

Figure 1:
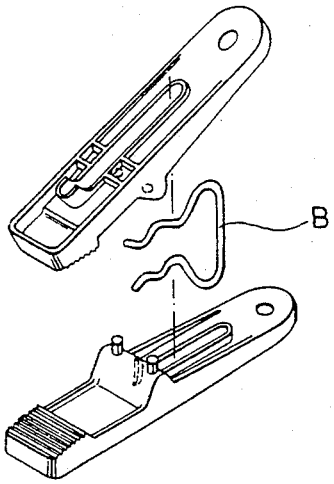
FIG. 1 PRIOR ART
FIG. 1 is a conventional spring clip.
Figure 2:
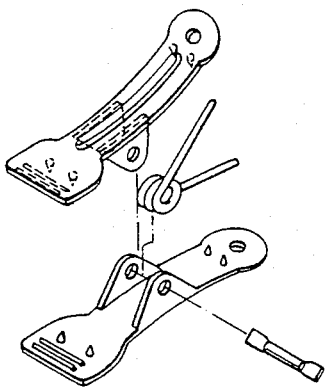
FIG. 2 PRIOR ART
FIG. 2 is another conventional spring clip.
Figure 3:
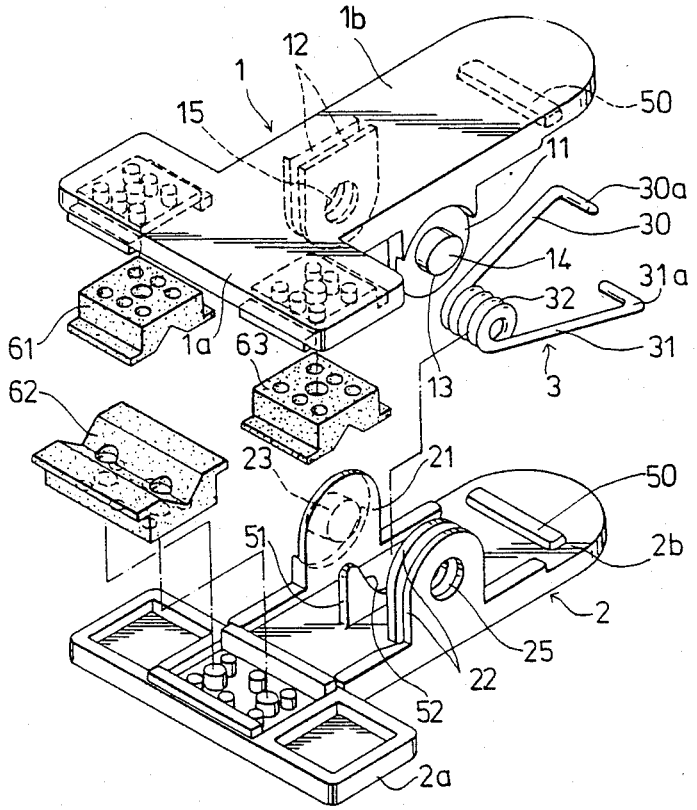
FIG. 3 is an exploded view of a spring clip according to the present invention.
Figure 4:
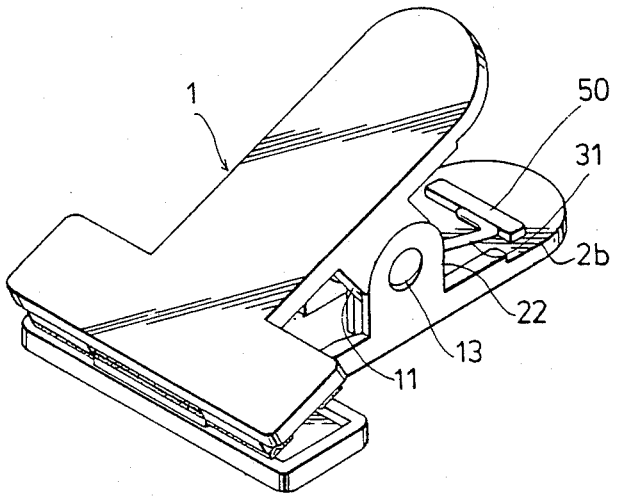
FIG. 4 is a perspective view of the spring clip of FIG. 3.

Referring to FIGS. 3 and 4, a spring clip is shown, having a first clamping member 1 with a first clamping portion 1*a* and a first press plate 1*b*, and a second clamping member with a second clamping portion 2*a* and a second press plate 2*b*. The first and second press plates 1*b* and 2*b* are connected pivotally to one another to turn about an axis so as to cause the first and second clamping portions 1*a* and 2*a* to move towards or away from one another.

The first press plate 1*b* is provided with at one side thereof a flange 11 and at another side thereof two parallel sandwiching flanges 12 which are spaced apart from one another to have a gap therebetween. On the flange 11 is a boss 13 of circular cross-section which extends perpendicularly and outwardly from the flange 11. The end face 14 of the boss 13 is slanted relative to a plane perpendicular to the axis of the boss 13. In the flanges 12 are provided holes 15.

The second press plate 2*b* is provided with at one side thereof a flange 21 and at another side thereof two parallel sandwiching flanges 22 which are spaced apart from one another to have a gap therebetween. On the flange 21 is a boss 23 of circular cross-section which extends perpendicularly and outwardly from the flange 21. The end face of the boss 23 is slanted relative to a plane perpendicular to the axis of the boss 23. In the flanges 22 are provided holes 25 respectively.

The flange 11 is inserted between the two flanges 22, and the boss 13 is inserted into the hole 25 of the outer flange 22. Due to the presence of the inner flange 22 which cooperates with the outer flange 22 to sandwich the flange 11, the flange 11 will not separate from the outer flange 22 and thus the boss 13 thereof can not be released easily from the hole 25 of the flange 22. Likewise, the flange 21 is inserted between the two flanges 12, and the boss 23 is inserted into the hole 15 of the outer flange 12. It can be noted that the bosses 13 and 23 with slanted end faces enable the flanges 11 and 21 to enter between the sandwiching flanges 22 and 12 like a wedge, and the process of connecting the clamping members 1 and 2 is thereby facilitated.

A torsion spring 3 is further mounted on the clamping members 1 and 2 so as to urge the clamping members 1 and 2 to a clamping position. The torsion spring 3 includes a coiled portion 32, a first arm portion 30 extending from one side of the coiled portion 32 toward the clamping member 1 and having a bent end 30a extending inward to be parallel with the axis of the coiled portion 32, and a second arm portion 31 extending from the other side of the coiled portion 32 toward the clamping member 2 and having a bent end 31*a* extending inward to be parallel with the axis of the coiled portion 32. Retaining members 50 and 51 are disposed on the clamping members 1 and 2 so as to hold the spring 3 by a clamping action. The retaining members 50 are elongated transverse ridges protruded inward respectively from the inner surfaces of the clamping members 1 and 2 to engage with the bent end 30*a* and 31*a* respectively, and the retaining member 51 is an elongated longitudinal projection of the clamping member 2 between the flange 21 and the inner flange 22, having a curved engaging surface 52 which has a gradually increasing height from one end near the retaining member 50 to the opposite end. The curved engaging surface 52 serves as a seat for the coiled portion 32 of the spring 3. The retaining member 50 on the clamping member 2 and the clamping member 1 hold the spring 3 tightly against the the engaging surface 52 of the retaining member 51. The retaining member 50 of the clamping member 1 is provided not essentially, but preferably.

On the inner surfaces of the clamping portions 1*a* and 2*a* of the clamping members 1 and 2 are rubber pads 61, 62 and 63 which are attached thereto by the interengagement of protrusions and recesses. The pads 61, 62 and 63 provide a protection for the article which will be clamped between the clamping portions 1*a* and 2*a*.

It can be appreciated that the assembly of the spring clip of the invention can be accomplished easily, since the clamping members can be pivoted to one another without using a pivot pin and the torsion spring can be mounted conveniently by engaging it with the retaining members.

With the invention thus explained, it is apparent that various modifications and variations can be made without departing from the scope of the invention. It is therefore intended that the invention be limited as indicated in the appended claims.

What I claim is:

1. A clip comprising, a first clamping member having a first clamping portion, a first press plate portion, and a first inner surface extending from said first clamping portion to said first press plate portion, a second clamping member having a second clamping portion, a second press plate portion, and a second inner surface facing said first inner surface and extending from said second clamping portion to said second press plate portion, said first and second press plate portions being connected pivotally to one another to turn about a pivot axis so as to cause said first and second clamping portions to move towards one another or to move away from one another, each of said first and second plate portions including at one side thereof a first flange extending inwardly and perpendicular to said pivot axis and having a boss of circular cross-section extending perpendicularly from said first flange, and at the opposite side thereof a second flange being parallel to said first flange and having a pivot hole, said boss of said first or second press plate portion being inserted into said pivot hole of said second or first press plate portion, each of said first and second press plate portions further having a third flange parallel to and spaced apart from said second flange to create a gap between said second and third flanges so as to sandwich said first flange when said boss is inserted into said pivot hole, each of said bosses having an end face slanted relative to a plane perpendicular to said pivot axis to enable said first flange to wedge in between respective said second and third flanges, a torsion spring disposed between said first and second press plate portions and having a coiled portion, a first arm at one side of said coiled portion extending toward said first press plate portion and having an inwardly bent end parallel to said pivot axis, and a second arm at another side of said coiled portion extending toward said second press plate portion and having an inwardly bent end parallel to said pivot axis, and a spring retaining means including at said second inner surface a transverse ridge which is parallel to said pivot axis and engages with said bent end of said second arm, and a longitudinal projection on said second inner surface between said first and third flanges, having a curved engaging surface with a gradually increasing height from one end near said transverse ridge to the opposite other end, said curved engaging surface serving as a seat for said coiled portion.

2. A spring clip as claimed in claim 1, wherein said first press plate portion has at said first inner surface a transverse ridge parallel to said pivot axis to engage with said bent end of said first arm.

3. A spring clip as claimed in claim 1, wherein said first and second clamping portions are provided with pads at said first and second inner surfaces.

* * * * *